United States Patent [19]

Dickie

[11] Patent Number: 5,057,036

[45] Date of Patent: Oct. 15, 1991

[54] PULL RING LOCKING MECHANISM

[75] Inventor: Robert G. Dickie, Newmarket, Canada

[73] Assignee: Paige Manufacturing Inc., Toronto, Canada

[21] Appl. No.: 644,132

[22] Filed: Jan. 22, 1991

[51] Int. Cl.[5] ..... H01R 13/00

[52] U.S. Cl. ..... 439/484

[58] Field of Search ..... 439/484, 692, 694, 372, 439/347

[56] References Cited

U.S. PATENT DOCUMENTS

| | | | |
|---|---|---|---|
| 1,844,916 | 2/1932 | Dykes | 439/372 |
| 2,643,139 | 6/1953 | Hamilton | 439/372 X |
| 4,681,387 | 7/1987 | Paddock | 439/347 |
| 4,768,969 | 9/1988 | Bauer et al. | 439/372 X |
| 4,904,202 | 2/1990 | Uchida | 439/372 |
| 4,927,376 | 5/1990 | Dickie | 439/484 |

FOREIGN PATENT DOCUMENTS

| | | | |
|---|---|---|---|
| 2026196 | 12/1971 | Fed. Rep. of Germany | 439/484 |

*Primary Examiner*—Neil Abrams
*Assistant Examiner*—Khiem Nguyen
*Attorney, Agent, or Firm*—Robert O. Nimtz

[57] ABSTRACT

A pivotable pull ring is permanently attached to a low profile electrical plug by fashioning a locking stub at the attaching ends of the pull ring. Matching lock stub cavities in the electrical plug have "one-way" locking tabs which accept the locking stubs into the locking cavity during assembly, but which block the removal of the locking stub from the locking stub cavity once the locking stub is assembled into the locking stub cavity. The locking tab has a gentle ramp on the outside, to facilitate displacement of the locking tab to allow entry of the locking stub during assembly, but has an abrupt shoulder on the inside to prevent displacement of the locking tab after assembly.

5 Claims, 2 Drawing Sheets

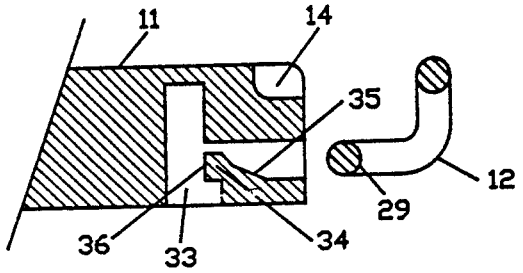
FIG. 5
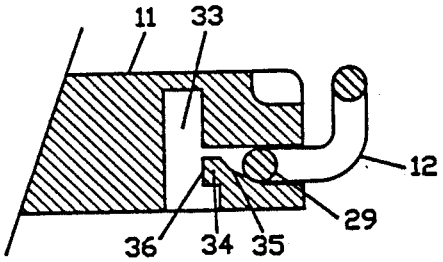
FIG. 6
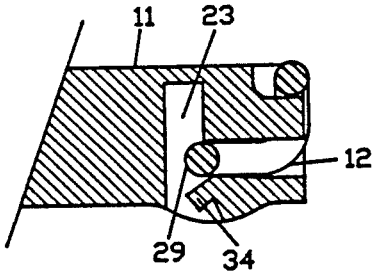
FIG. 7
FIG. 8
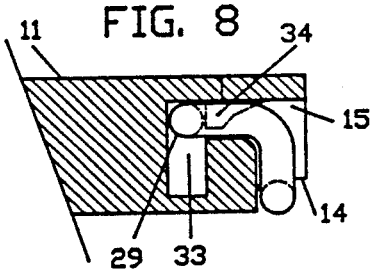
FIG. 9
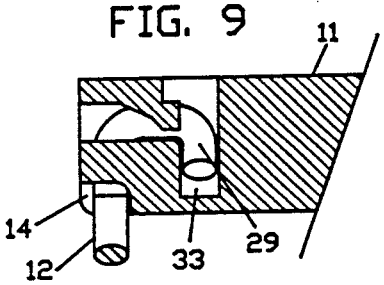
FIG. 10
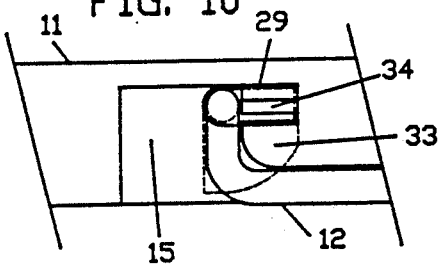
FIG. 11
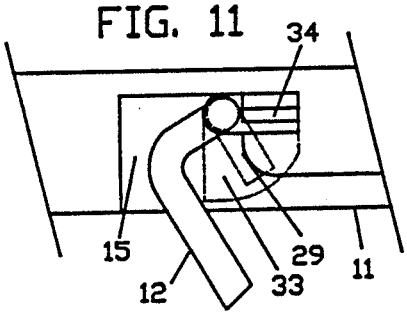

PULL RING LOCKING MECHANISM

TECHNICAL FIELD

This invention relates to locking mechanisms and, more particularly, to locking mechanisms for pivoting pull rings.

BACKGROUND OF THE INVENTION

It has become common to attach pull rings to small objects to facilitate manipulating such objects by hand. Typical examples of such objects include electrical plugs, hand tools and toys. Such pull rings are preferably pivotal so as to pivot from a storage position in which they are out of the way, to extended operational position in which they can be used to manipulate the object. Since such rings must be free to rotate or pivot in order to move from the storage position to the operational position, such a pull ring is not permanently attached to the object it is intended to accommodate.

As a result of failure to permanently attach a pull ring to the object it is intended to accommodate, such rings can become detached from the object, making the manipulation of the object difficult or even impossible. Moreover, the dislogement of such pull rings from the accommodated object permits the pull ring to be swallowed by small children, thus presenting a health hazard. Finally, if the object with with which the pull ring is used is a flat, very thin electrical plug, the dislogement of the ring results in users attempting to remove the plug by inserting fingers under the plug. Such placement of fingers, particularly by infants, children and persons without full use of their hands, significantly increases the hazards of electrical shock from the live electrical pins on the plug. One such electrical plug is shown in applicant's U.S. Pat. No. 4,127,376, granted May 22, 1990, and assigned to applicant's assignee.

SUMMARY OF THE INVENTION

In accordance with the illustrative embodiment of the present invention, a pivoting pull ring is semi-permanently attached to the object whose manipulation is to be facilitated thereby. The attachment is made in such a fashion as to prevent removal by normal usage or by significant efforts directed at such removal.

More particularly, the pivoting pull ring is fashioned with lock stubs at an angle to the secured end of the pull ring. The object to be manipulated by the pull ring is fashioned with a lock stub cavity which can be entered during assembly by the lock stub deforming a lock tab to push the lock tab out of the way to permit entry of the lock stub into the lock stub cavity. Once the lock stub is in the lock stub cavity, the lock tab returns to its original position which locks the lock stub into the lock stub cavity. The lock tab is fashioned with a gradual ramp on the side away from the lock stub cavity to facilitate the gradual deformation of the lock tab as the lock stub is forced over the lock tab. The side of the lock tab facing the lock stub cavity, however, is fashioned with an abrupt vertical face which prevents the lock stub from deforming the lock tab from the lock stub cavity side, thereby permanently locking the lock stub into the lock stub cavity.

The present invention will be described in connection with the flat electrical plug disclosed in applicant's U.S. Pat. No. 4,927,376, granted May 22, 1990. It is to be understood, however, that the principles of this invention can be applied to pull rings for any other objects and, indeed, for fastening two objects together with pivotable connection pieces.

It will be noted that, when the present invention is used with a low profile electrical plug, the pull ring is permanently locked into the plug, thus avoiding the possibility of small children swallowing the ring or attempting to remove the plug with their fingers, were the pull ring capable of being separated from the plug.

One feature of the present invention is the simplicity and low cost of permanently attaching pull rings to molded objects. The lock stubs on the pull ring add very little cost to the pull ring while the lock stub cavity can very readily be formed in the object by injection molding techniques without significantly adding to the cost of the molded product.

BRIEF DESCRIPTION OF THE DRAWINGS

A complete understanding of the present invention may be gained by considering the following detailed description in conjunction with the accompanying drawings, in which:

FIG. 5 shows a partial cross-sectional view of one edge of the electrical plug of FIG. 1 showing the pull ring about to be inserted into the pull ring cavity;

FIG. 6 shows a partial cross-sectional view of the edge of the electrical plug shown in FIG. 5 showing the pull ring just beginning to engage the deformable lock tab at the entrance to the lock stub cavity;

FIG. 7 shows a partial cross-sectional view of the edge of the electrical plug shown in FIG. 5 showing the pull ring fully engaged with the deformable lock tab at the entrance to the lock stub cavity;

FIG. 8 shows a partial cross-sectional view of the edge of the electrical plug shown in FIG. 1 showing the pull ring in a retracted position;

FIG. 9 shows a partial cross-sectional view of the edge of the electrical plug shown in FIG. 8 showing the pull ring in a partially open position;

FIG. 10 is a cut-away edge view of the electrical plug shown in FIG. 1 showing the pull ring in a retracted position; and FIG. 11 is a cut-away edge view of the electrical plug shown in FIG. 10 showing the pull ring in a partially open position.

To facilitate reader understanding, identical reference numerals are used to designate elements common to the figures.

DETAILED DESCRIPTION

Figure 1:
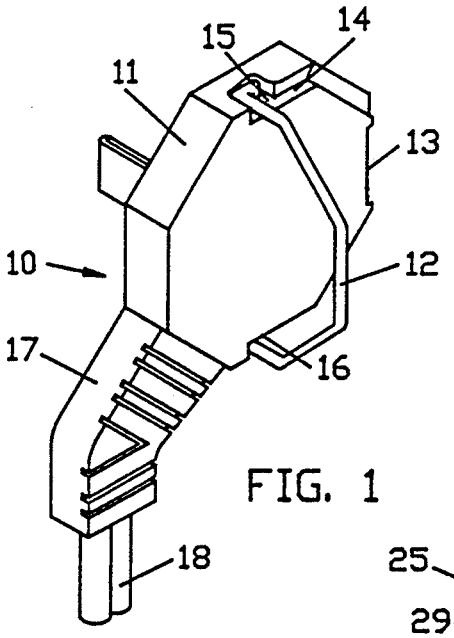
FIG. 1 shows a perspective view of an electrical plug having a pull ring in accordance with the present invention.

In FIG. 1 there is shown a perspective view of a low profile electrical plug 10 having an octagonal body portion 11 and a pull ring 12. The body portion 11 includes a cutout 13 to facilitate the grasping of ring 12 when ring 12 is in the retracted position in groove 14 around half of the upper edge of body 11. Recesses 15 and 16 provide clearance for rotating ring 12 between the open position (illustrated in FIG. 1) and the retracted position (lying in groove 14). A sleeve 17 guides a line cord 18 from the interior of body 11 to the appliance (not illustrated in FIG. 1). On the obverse side of plug body 11 (not visible in FIG. 1) are the electrical pins which allow plug 10 to be inserted into a standard electrical wall socket in order to deliver electrical energy to the aforesaid appliance. The plug 10 is claimed and disclosed in greater detail in applicant's U.S. Pat. No. 4,927,376, granted May 22, 1990.

Figure 2:
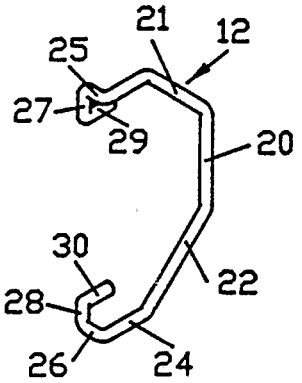
FIG. 2 shows a perspective view of the pull ring of the electrical plug shown in FIG. 1.

In FIG. 2 there is shown a perspective view of the ring 12 detached from the plug body 11. As can be seen in FIG. 2, the ring 12 is a semi-octagonal shape to match the peripheral contour of plug body 11 and comprises a vertical portion 20, two angular portions 21 and 22 and two horizontal portions 23 and 24. At the ends of horizontal portions 23 and 24 are seating portions 25 and 26, respectively, which seat in the bottoms of recesses 15 and 16 (FIG. 1) when ring 12 is in the open position. At the ends of seating portions 25 and 26 are pivot bars 27 and 28, respectively, which act as pivots for ring 12 when ring 12 is moved from its closed position to its open position.

In accordance with the illustrative embodiment of the present invention, at the ends of pivot bars 27 and 28 are lock stubs or hooks 29 and 30, respectively. As will be described hereinafter, lock stubs 29 and 30 lock into lock stub cavities in the interior of plug body 11 in such a manner as to render the removal of ring 12 from body 11 virtually impossible. Since it is necessary that ring 12 always be available to remove plug 10 from a mating electrical socket, it is necessary to capture ring 12 in body 11 in such a fashion that ring 12 cannot be removed from body 11, even with the exertion of considerable effort such as might be exerted if the ring 12 is inadvertently snagged in moving furniture. As will be described in detail hereinafter, the lock stubs 29 and 30 are locked into lock stub cavities by means of deformable entrance tabs which readily deform to permit entrance of lock stubs 29 and 30, but which cannot be deformed to permit removal of lock stubs 29 and 30.

Figure 3:
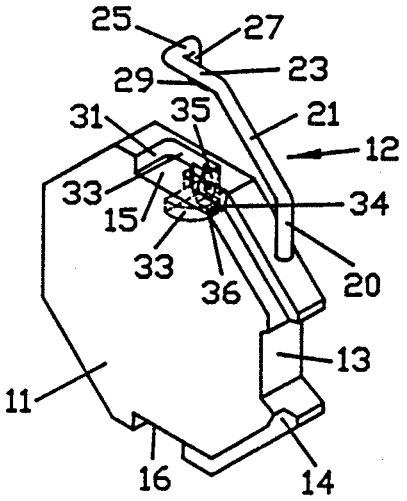
FIG. 3 shows a top perspective view of the electrical plug of FIG. 1 with the pull ring removed, and showing in dotted lines the interior pull ring cavity for the hooks at the end of the pull ring.

In FIG. 3 there is shown a perspective view of the upper surface of plug body 11 showing the details of the recess 15 in which the ring 12 is seated. Recess 15 comprises a shoulder 31 which limits the pivotal movement of ring 12 by engaging ring portion 23 to hold ring 12 in a position perpendicular to the plane of plug body 11. At the same time, the ring portion 25 engages seat portion 32 of recess 15, also limiting the pivotal movement of ring 12. The lock stub 29 fits into a quarter-circular lock stub cavity 33 shown in dashed lines in FIG. 3. Also shown in dashed lines in FIG. 3 is a ramp-shaped lock tab 34 at the entrance to lock stub cavity 34. As can be seen in FIG. 3, lock tab 34 has a gentle ramp 35 on the outwardly facing side of tab 34 which facilitates the insertion of lock stub 29 into lock stub cavity 33. Tab 34 is connected to plug body 11 in a cantilever fashion such that tab 34 can be deformed by the insertion of lock stub 29 into the entrance into lock stub cavity 33. The deformation of tab 34 opens the entrance to cavity 33 and allows lock stub 29 to enter cavity 33. On the inwardly facing side of tab 34, on the other hand, lock tab 34 has an abrupt vertical face 36 which prevents the deformation of lock tab 34 and therefore prevents the removal of lock stub 29 from the lock stub cavity 33. Recess 16, of course, also includes a complementary shoulder portion, a complementary seating portion, a complementary lock stub cavity guarded by a complementary lock tab for locking the lock stub 30 in the lock stub cavity.

Figure 4:
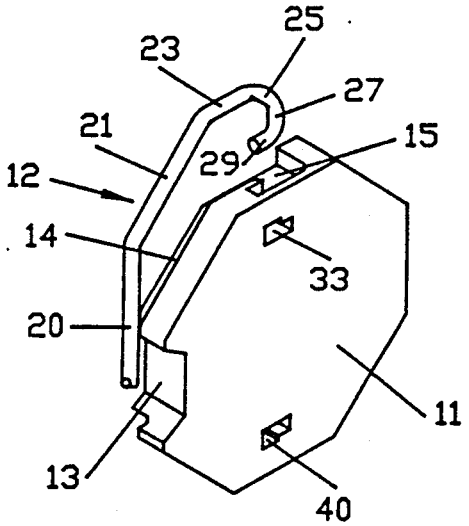
FIG. 4 shows a bottom perspective view of the electrical plug of FIG. 1 with the pull ring removed, showing the open bottom portion of the interior pull ring cavity.

In FIG. 4 there is shown a perspective view of the bottom of plug body 11 showing the recess 15. As can be seen in FIG. 4, the lock stub cavity 33 communicates with the bottom surface of plug body 11, as does the complementary lock stub cavity 40 at the other side of plug body 11. While such communication with the bottom surface of plug body 11 is not essential to the operation of the locking mechanism, such communication does facilitate the formation of cavities 33 and 40 by injection molding techniques in that such cavities can be formed by protrusions located on the core of the mold.

In FIGS. 5 through 7 there are shown partial sectional views of one edge of plug body 11 showing the insertion of the lock stub 29 into lock stub cavity 33. In FIG. 5, the ring 12 is poised outside of plug body 11 in preparation for insertion. In FIG. 6, the ring 12 is partially inserted into the plug body 11 so that the lock stub 29 is just beginning to engage the ramp-shaped portion 35 of lock tab 34. In FIG. 7, the lock stub 29 has fully engaged lock tab 34 and lock tab 34 has been deformed to give lock tab 34 entry into lock tab cavity 33. As is evident from FIG. 7, once lock stub 29 clears the edge of lock stub cavity 33, lock tab 34 is free to return to its underformed shape and position, thereby permanently locking lock stub 29 into lock stub cavity 33. The only way that lock stub 29 can thereafter be removed from cavity 33 is by destroying or removing lock tab 34.

In FIG. 8 there is shown a partial sectional view of one edge of plug body 11 showing the lock stub 29 fully inserted into lock stub cavity 33 and with ring 12 in the fully retracted position. In FIG. 9 there is shown a partial sectional view of one edge of plug body 11 showing the lock stub 29 fully inserted into lock stub cavity 33 and with ring 12 in the partially open position. It can be seen in FIG. 9 that the lock stub 12 finds, in lock stub cavity 33, clearance for rotation between the fully closed position to the fully open position.

In FIG. 10 there is shown a partial edge view of plug body 11 showing the lock stub 29 fully inserted into lock stub cavity 33 and with ring 12 in the fully retracted position. In FIG. 11 there is shown a partial edge view of plug body 11 showing the lock stub 29 fully inserted into lock stub cavity 33 and with ring 12 in the partially open position. FIG. 10 also shows the recess 15 and the quarter-circular shape of cavity 33 to provide clearance for lock stub 29 for the entire range of its motion of ring 12 from the fully closed position to the fully open position. In FIG. 11 there is shown a partial edge view of plug body 11 showing the lock stub 29 fully inserted into lock stub cavity 33 and with ring 12 in the partially open position. In FIG. 11 it can be seen that lock stub cavity 33 provides adequate clearance for lock stub 29 to permit ring 12 to be pivoted from its fully retracted position to its fully open position.

It should also be clear to those skilled in the art that further embodiments of the present invention may be made by those skilled in the art without departing from the teachings of the present invention.

What is claimed is:

1. An electrical plug comprising a molded plug body for mounting electrical pins, a removal ring for attachment to said plug body, said ring having a retracted position in close contact with said plug body and an open position disposed away from said plug body to facilitate grasping said ring for removal of said plug from a mating socket, a locking cavity in said plug body, a rigid locking stub on said removal ring for insertion into said locking cavity, and deformable means completely closing the entry to said locking cavity for permitting entry of said locking stub into said locking cavity by deforming in response to forces in the direction of said insertion, and for preventing exiting of said locking stub from said locking cavity by blocking deformation of said deformable means in response to forces in the direction opposite to said direction of insertion.

2. The electrical plug according to claim 1 wherein said removal ring comprises a semi-octagonal shaped deformable metal.

3. The electrical plug according to claim 1 wherein said plug body comprises molded deformable plastic material.

4. The electrical plug according to claim 1 wherein said means at the entry to said locking cavity comprises a deformable tab having a gentle ramp at the entrance side of said tab and an abrupt shoulder at the exit side of said tab.

5. The electrical plug according to claim 1 wherein said plug body includes a recess for holding said ring when said ring is in said fully retracted position, and said locking cavity includes a surface for holding said ring perpendicular to said plug body when said ring is in said fully open position.

* * * * *